US010549904B2

(12) United States Patent
Zapata Moran et al.

(10) Patent No.: US 10,549,904 B2
(45) Date of Patent: Feb. 4, 2020

(54) METAL AEROSOL CONTAINER AND METHOD OF MANUFACTURE

(71) Applicant: Envases Universales de Mexico SAPI de CV, Cuatitlan, Edo. de Mexico (MX)

(72) Inventors: Isaias Zapata Moran, Cuatitlan (MX); Marco Zapata Moran, Cuatitlan (MX); Alberto Alvarez Zavala, Cuatitlan (MX)

(73) Assignee: Envases Universales De Mexico Sapl, Cuatitlen, Edo. de Mexico, C.P. (MX)

( * ) Notice: Subject to any disclaimer, the term of this patent is extended or adjusted under 35 U.S.C. 154(b) by 882 days.

(21) Appl. No.: 14/829,724

(22) Filed: Aug. 19, 2015

(65) Prior Publication Data

US 2017/0050795 A1 Feb. 23, 2017

(51) Int. Cl.

| | |
|---|---|
| ***B21D 51/26*** | (2006.01) |
| ***B65D 83/38*** | (2006.01) |
| ***B65D 6/02*** | (2006.01) |
| ***B65D 6/32*** | (2006.01) |

(Continued)

(52) U.S. Cl.

CPC ..... *B65D 83/38* (2013.01); *B21D 51/2638* (2013.01); *B21D 51/2646* (2013.01); *B21D 51/2676* (2013.01); *B65D 7/02* (2013.01); *B65D 7/38* (2013.01); *B65D 83/205* (2013.01); *B65D 83/28* (2013.01)

(58) Field of Classification Search

CPC .... B21D 41/04; B21D 51/26; B21D 21/2623; B21D 51/2638; B21D 51/2653; B21D 51/2676; B21D 51/2615; B21D 26/46; B21C 37/08; B23K 26/244; B23K 26/262; B65D 7/04

See application file for complete search history.

(56) References Cited

U.S. PATENT DOCUMENTS 2,384,810 A * 9/1945 Calleson ..... B65D 7/04 220/62
3,581,542 A * 6/1971 Wahler ..... B21D 41/04 72/354.6

(Continued)

OTHER PUBLICATIONS

International Preliminary Report of Patentability dated Mar. 1, 2018 in corresponding International Application No. PCT/IB2015/001905.

(Continued)

*Primary Examiner* — Edward T Tolan
(74) *Attorney, Agent, or Firm* — Polsinelli, PC

(57) ABSTRACT

Two-piece metal aerosol container and method of manufacture are provided in accordance with the present invention. A rolled and longitudinally welded cylindrical tube forms the container body, including a cylindrical sidewall and reduced diameter shoulder and neck portions (formed by a sequential necking process), while a separate metal base component is attached via a crimped seam. The open-top end of the container neck portion is curled to receive a manually actuatable dispensing valve assembly. The container is resistant to internal pressures in excess of 311 psi (2150 kPa) and offers increased strength and pressure resistance (compared to a three piece rolled metal aerosol container), while being easy to manufacture and low in cost.

13 Claims, 13 Drawing Sheets

(51) Int. Cl.
*B65D 83/20* (2006.01)
*B65D 83/28* (2006.01)

(56) References Cited

U.S. PATENT DOCUMENTS 3,786,957 A * 1/1974 Hilgenbrink ..... B21D 51/2615 220/656
3,995,572 A * 12/1976 Saunders ..... B21D 51/2615 72/348
4,152,573 A * 5/1979 Saurin ..... B23K 26/244 219/121.63
4,173,883 A 11/1979 Boik
4,261,193 A * 4/1981 Boik ..... B21D 41/04 72/349
4,392,764 A * 7/1983 Kubis ..... B21D 51/2638 413/69
4,753,364 A 6/1988 Stoffel et al.
4,854,149 A 8/1989 Porucznik et al.
5,285,916 A * 2/1994 Ross ..... B65D 83/70 220/581
5,713,235 A * 2/1998 Diekhoff ..... B21D 51/2615 413/69
2006/0032889 A1 * 2/2006 Weil ..... B21C 37/0818 228/44.3

OTHER PUBLICATIONS

Int'l. Search Report and Written Opinion dated May 2, 2016 in corresponding Int'l. Appln. No. PCT/IB2015/001905.

* cited by examiner

METAL AEROSOL CONTAINER AND METHOD OF MANUFACTURE

BACKGROUND

1. Technical Field

The present invention is in the field of metal container manufacturing, and more specifically in the field of metal containers adapted to dispense a pressurized or aerosol product.

2. Introduction

Metal cans and containers have long been used to hold and dispense a wide variety of goods and materials, in solid, liquid, or gaseous forms. When used to hold an aerosol product, the metal containers are designed to withstand pressure fluctuations caused by external factors such as temperature variations. Such containers may also be subjected to large mechanical stresses and pressure spikes caused by drops and other sudden impacts, providing a further design consideration. Depending on the intended application of the metal container, a combination of qualities is required. Such qualities might include cost, durability, strength, and manufacturing speed.

The most common type of metal container is formed from a flat metal disc, usually aluminum, which is stretched into a cup-like shape through an inelastic process known as drawing and ironing. A pre-formed metal top is then attached to complete the container. For use in low-pressure applications, drawn metal containers are desirable because of their low cost and high speed of manufacture. Drawn metal containers are most commonly used to hold carbonated beverages. However, these drawn containers have thin walls that are subject to variance in thickness and are more prone to burst and fail at higher pressures or when subjected to impacts or drops.

Rolled metal containers are also available, wherein a flat piece of sheet metal, usually steel, is formed into a cylinder, and base and top components are each attached via crimped seams to the cylindrical sidewall to complete the container. These containers have a more consistent wall thickness than drawn containers, and because they are less likely to suffer burst failures at high pressures, are most commonly used in higher-pressure (e.g. aerosol) applications. However, the top and bottom crimped seams make the container heavy and cause a greater probability of failure from impacts or drops when compared to a drawn container.

Thus there is an ongoing need for a metal container, particularly in aerosol applications, that can be manufactured to withstand high pressure and failure from impacts and drops, while minimizing the number of crimped seams required.

SUMMARY OF THE INVENTION

A two-piece metal aerosol container and method of manufacture are provided in accordance with the present invention. A rolled and longitudinally welded cylindrical tube forms the container body, including a cylindrical sidewall, and reduced diameter shoulder and neck portions (formed by a sequential necking process), while a separate metal base component is attached via a crimped seam. The open-top end of the container neck portion is curled to receive a manually actuatable dispensing valve assembly. The container is resistant to internal pressures in excess of 311 psi (2150 kPa) and offers increased strength and pressure resistance (compared to a three-piece rolled metal aerosol container), while being easy to manufacture and low in cost.

In accordance with one embodiment of the invention, a method is provided for manufacturing a metal container adapted to receive a dispensing valve assembly for dispensing pressurized or aerosol products from the container, wherein said container is formed from two pieces of metal, including the steps of: providing a metal body component and a metal base component; rolling the metal body component into a generally tubular shape having two longitudinal proximate free edges, and open top and bottom-ends; welding the longitudinal proximate free edges of the tubular shape to form a longitudinal weld seam, thereby forming a welded cylindrical body of a first diameter with open top and bottom ends; forming the container by: forming and sealing the metal base component to the open bottom-end of the welded cylindrical body to form a closed container bottom; sequentially necking in a top portion of the welded cylindrical body to create an inwardly tapering shoulder portion ending in a neck portion having a reduced second diameter relative to the first diameter of the welded cylindrical body; forming a curl at the open top-end of the neck portion, the curl being configured to receive a dispensing valve assembly for dispensing a pressurized or aerosol product from the container; wherein the weld seam extends continuously throughout the shoulder portion, neck portion, and curl.

In one embodiment, the container when sealed with a dispensing valve assembly and pressurized to 256 psi (1765 kPa) withstands deformation at 100° F. (37.7° C.) for at least 10 minutes.

In one embodiment, the container when sealed with a dispensing valve assembly and pressurized to 311 psi (2150 kPa) withstands explosive failure at 100° F. (37.7° C.) for at least 5 minutes.

In one embodiment, the metal body component has a height in a range of 2.5 inches to 9.5 inches and a first diameter in a range of 1.7 to 3.25 inches.

In one embodiment, the metal body component and the metal base component are each pre-cut from steel sheet.

In one embodiment, the second diameter is at most 50% of the first diameter.

In one embodiment, the second diameter is in a range of 40% to 50% of the first diameter.

In one embodiment, the second diameter is in a range of 20% to 40% of the first diameter.

In one embodiment, the welding step comprises applying welding spots at spaced positions along one or more of the free edges to form the weld seam.

In one embodiment, the necking step comprises sequentially applying a series of reducing diameter necking dies to form the shoulder and neck portions.

In one embodiment, the necking dies produce a shoulder having an inwardly concave, outwardly concave or flat sloped shape.

In one embodiment, the series of necking dies stretch the top portion of the welded cylindrical body to form the shoulder and neck portions where the reduced second diameter of the neck portion is no greater than 50% of the first diameter without causing fracture or failure of the weld seam.

In one embodiment, the method further comprises trimming excess material from the neck portion prior to forming the curl.

In one embodiment, the steps of manufacture are performed sequentially.

In accordance with another embodiment of the invention, a two-piece metal container is provided comprising: a cylindrical body component made from a single continuous piece of sheet metal rolled into a tubular form and welded to form a continuous weld seam in a direction parallel to a longitudinal axis of the container, the welded cylindrical body component being of a first diameter having open top and bottom ends; a metal base component formed and sealed to close the open bottom end of the welded cylindrical body component to form a closed container bottom; the cylindrical body component having a top portion necked in along the longitudinal length of the top portion to form an inwardly tapering shoulder portion ending in a neck portion having a reduced second diameter relative to the first diameter of the welded cylindrical body; the open top-end of the neck portion having a curled lip configured to receive a dispensing valve assembly for dispensing a pressurized or aerosol product from the container.

In one embodiment, the container when sealed with a dispensing valve assembly and pressurized at 256 psi (1765 kPa) withstands deformation at 100° F. (37.7° C.) for at least 10 minutes.

In one embodiment, the container when sealed with a dispensing valve assembly and pressurized to 311 psi (2150 kPa) withstands explosive failure at 100° F. (37.7° C.) for at least 5 minutes.

In one embodiment, the welded container body component has a height in a range of 2.5 inches to 9.5 inches and a first diameter in a range of 1.7 to 3.25 inches.

In one embodiment, the shoulder portion is of an inwardly concave, outwardly concave or flat sloped.

In one embodiment, the second diameter is at most 50% of the first diameter.

In one embodiment, the second diameter is in a range of 40% to 50% of the first diameter.

In one embodiment, the second diameter is in a range of 20% to 40% of the first diameter.

Additional aspects and/or advantages of the invention will be set forth in the description which follows.

BRIEF DESCRIPTION OF THE DRAWINGS

These and/or other aspects and advantages of the invention will be apparent from the following description of various embodiments, taken in conjunction with the accompanying drawings of which.

DETAILED DESCRIPTION

Figure 1:
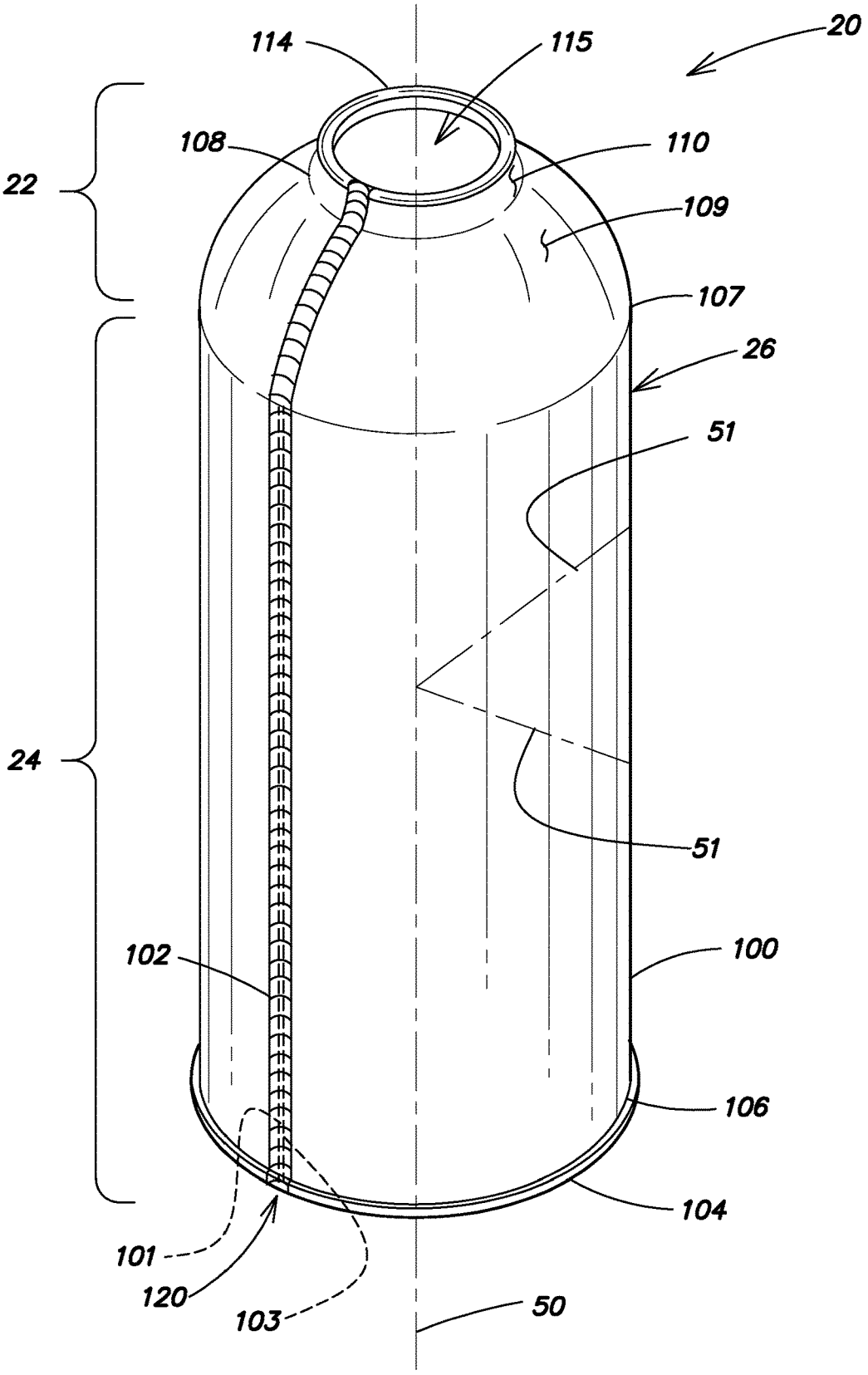
FIG. 1 is a perspective view of a final assembly of a two-piece metal aerosol container manufactured according to one embodiment of the present invention.

FIG. 1 is a perspective view of a final assembly of a two-piece metal aerosol container 20 manufactured according to one embodiment of the present invention. For purposes of clarity, FIG. 1 depicts the container without an attached aerosol valve and closure assembly. When referring to dimensions or directions, unless stated otherwise, all descriptions assume that the container is disposed in a vertically upright manner, wherein the longitudinal axis 50 runs from the base of the container to the top of the cylindrical container body, and the radial axis 51 is transverse to the longitudinal axis.

The two-piece metal aerosol container 20 includes a container body 26 and a container base 104, the body 26 including top and bottom portions 22, 24 respectively, with an open bottom end of the bottom portion 24 being sealed by the base 104. In a feature of this invention, a weld seam 102 traverses the entire longitudinal length of the container body 26, beginning at the bottom end 120 of the bottom portion 24 and continuing uninterrupted upwardly through the top portion 22. The top portion 22 includes, in serial order from bottom to top, a tapered shoulder portion 109, a cylindrical neck portion 110, and a curled lip 114 formed on an upper edge of the cylindrical neck portion, creating an open top-end 115. Bottom portion 24 and top portion 22 are fabricated from a single, continuous, first piece of sheet metal, preferably steel, and collectively form a one-piece welded cylindrical container body 26 of the two-piece aerosol container 20. A second piece, a metal base 104, is formed from a single, continuous second piece of sheet metal, preferably steel. The metal base 104 is attached to the open bottom end of the cylindrical body via a crimped seam 106 (e.g. a double seam), which is airtight and pressure-resistant (e.g. up to at least 256 psi (1765 kPa) for applications such as an aerosol paint container). This crimped seam 106 is the only additional seam required anywhere on container 20. Generally, it is the strength of this crimped seam 106, rather than the welded seam 102, that tends to be the limiting factor in the container's strength against deformation due to internal pressurization and/or the forces applied on drop impact.

In the disclosed embodiment, the top portion 22 includes a tapered shoulder portion 109 extending from an upper edge 107 of the cylindrical sidewall 100, and shaped concave outwardly, although one skilled in the art would appreciate that other taper geometries are possible to construct, e.g. concave inwardly or linear (flat sloped shape). The tapered portion and/or the sidewall and neck portions may also include additional features such as ribs or grooves. The internal diameter of the tapered shoulder portion 109 continually decreases, going from edge 107 (where it adjoins the cylindrical sidewall 100) to an upper edge 108 where it adjoins the cylindrical neck portion 110, which is of constant diameter. A curled lip 114 is formed from an upper edge portion of the cylindrical neck portion, the lip being configured to receive an aerosol valve and closure assembly that is typically attached to the container by crimping (and typically performed by a third party aerosol bottler). The transitions between cylindrical sidewall portion 100, tapered shoulder portion 109, cylindrical neck 110 and lip 114 are all seamless as all portions are formed from a single sheet of metal as described further below.

FIGS. 2-7 illustrate one embodiment of making the aerosol container of FIG. 1. FIG. 2A is a diagrammatic view of a beginning sheet metal form 10. In this embodiment, a flat planar metal body component (form) 10 is cut or stamped from a sheet of steel with a thickness between 0.0065 inches and 0.0094 inches, with pre-determined dimensions of 8.142 inches×7.038 inches, which are suitable to produce an aerosol container with a body diameter (body portion 24 in FIG. 1) of 2 11/16 inches. In alternate embodiments, the dimensions of the metal body component may vary to allow the metal body component to have a height in a range of 2.5 to 9.5 inches, and a diameter in a range of 1.7 to 3.25 inches. The open top-end 115 of container body 26 will eventually have a diameter less than 50% (and as low as 30%) of that of the bottom portion 24. However, prior to a sequential necking process, the top portion of metal form 10, including a shoulder forming portion 109*a*, neck forming portion 110*a*, and lip forming portion 114*a* all begin with the same horizontal width as a body forming portion 100*a* from which the cylindrical sidewall is formed. In the process of sequential necking to form the reduced diameter container top portion 22 (which occurs after forming the longitudinal weld seam 102), material is not removed except (as needed) to deburr or otherwise provide minor smoothing for a finished edge trim. The material of forming portions 109*a*/110*a*/114*a* is redistributed to form the tapered shoulder portion 109, neck portion 110, and curl portion 114 respectively, during the sequential necking process. This redistribution leads to a variable thickness in the wall of the container body 26. In various embodiments, certain areas of the three aforementioned components 109/110/114 are increased in thickness by up to 50%, and typically in the range of 30%-45%, all as compared to the cylindrical container sidewall portion 100 (which remains of same constant thickness as the form 10). The variable thickness in the top portion has the advantage of providing greater strength and reinforcement where needed, namely in the shoulder 109, neck 110, and lip 114 portions, reducing overall container weight and cost as compared to the alternative of forming the entire aerosol container out of sheet metal with a thickness equal to the thickness found in the cylindrical sidewall (bottom portion) 24 of the body component 26.

Figure 2B:
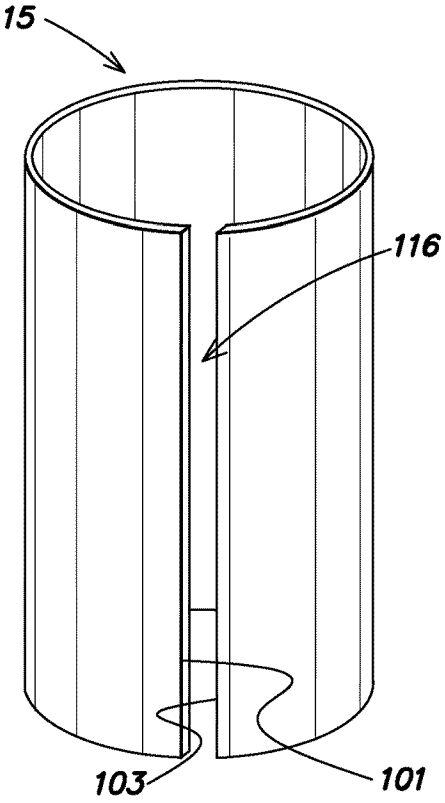
FIG. 2B is a perspective view of a generally tubular body form.
Figure 2A:
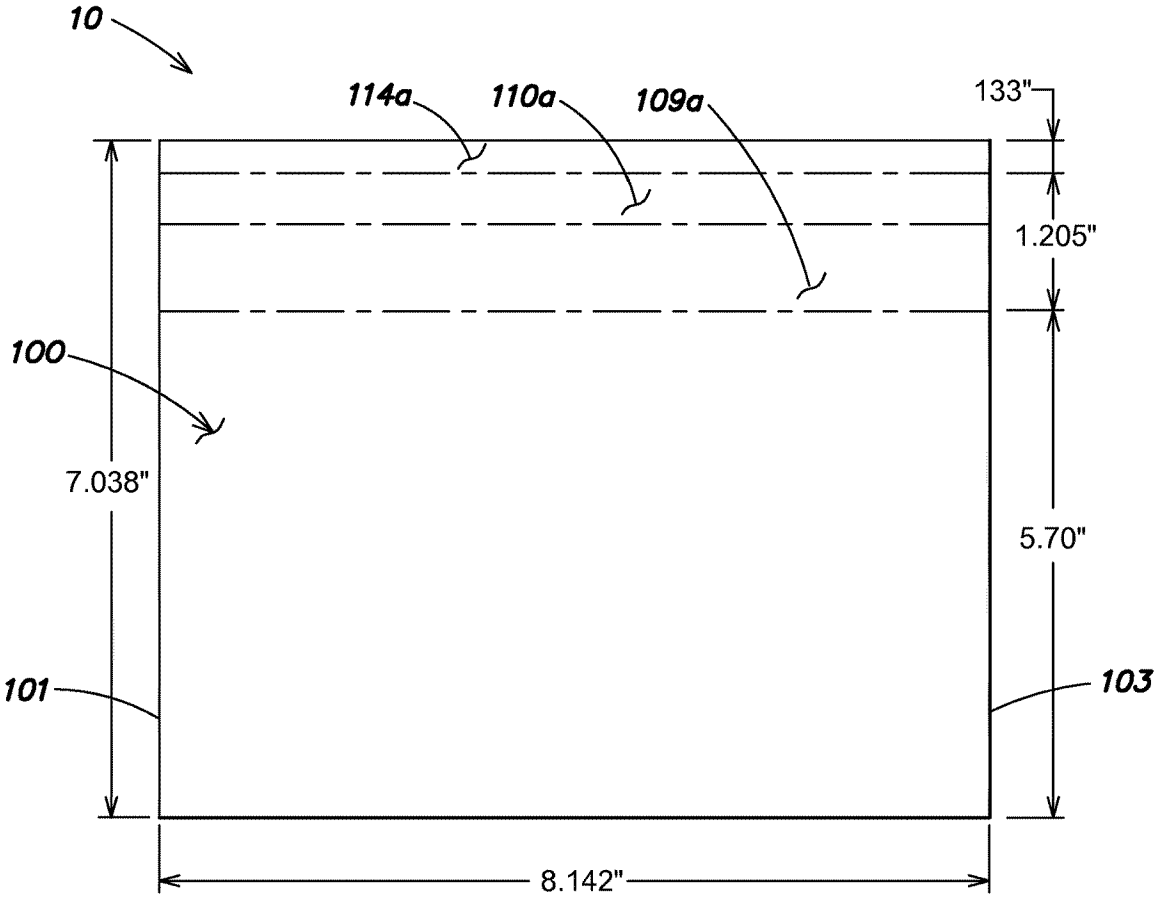
FIG. 2A is a top plan view of a beginning sheet metal form.
Figure 3:
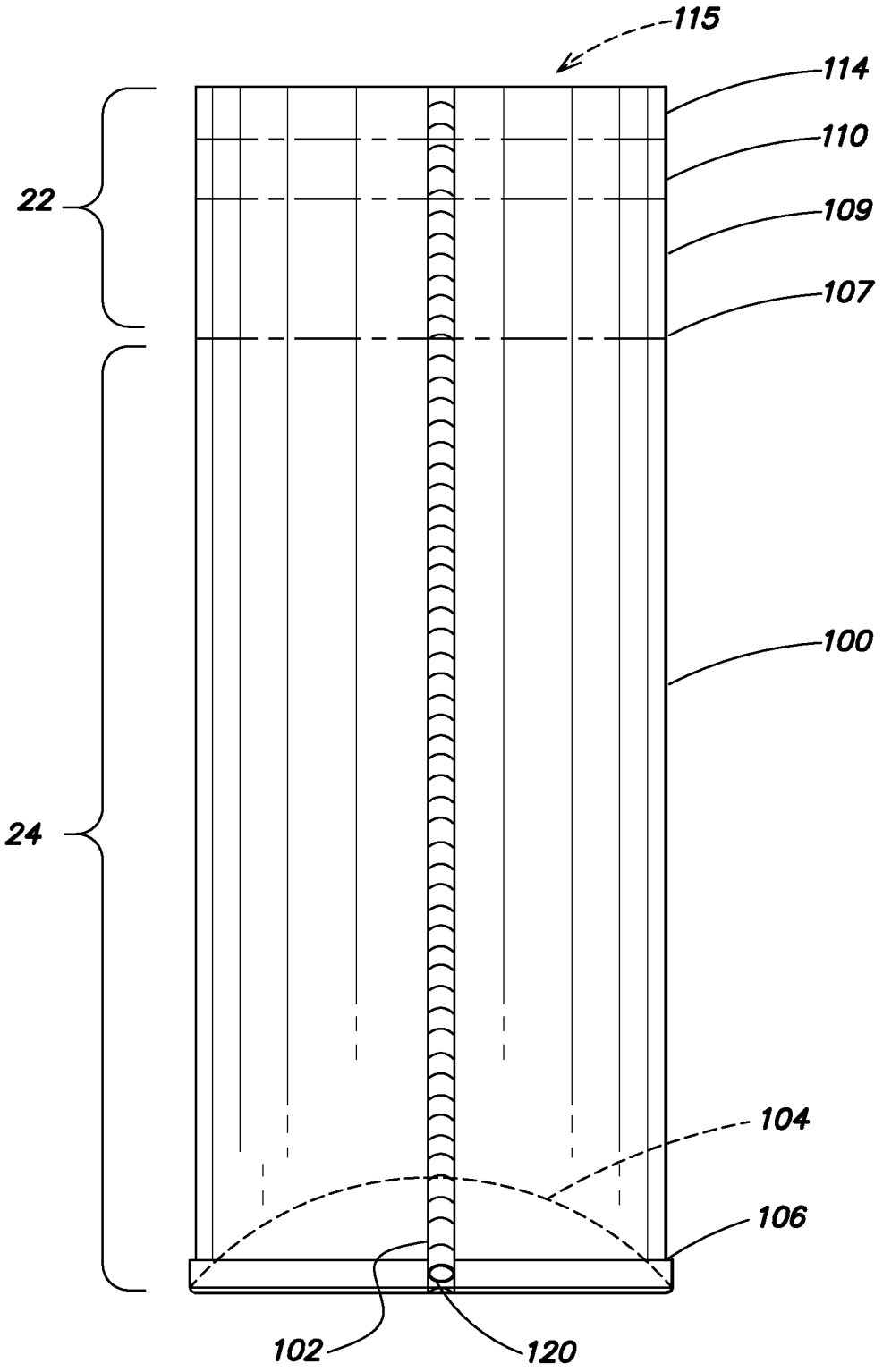
FIG. 3 is a front view of the partially formed container, after a concave metal base has been attached but prior to the necking process at the open top-end.

The metal body component (form) 10 may be stacked with other identical body components, and loaded into a tube-making machine, which pulls a single body component between a pair of heavy rollers, thereby rolling the body component into a generally tubular body 15, as seen in FIG. 2B. A pair of longitudinal free edges, 101 and 103 of tubular body 15, now proximately located, form an elongated longitudinal opening or slit 116, extending longitudinally between the open top and bottom ends of the tubular body, and wherein the slit vertically traverses the entire longitudinal length of the tubular body 15. Until the slit 116 is sealed, the tubular body alone has little in the way of rigidity or structural integrity. It is the application of the weld seam 102 between the two free edges 101 and 103 that create a rigid container body that is able to resist and contain typical aerosol pressure forces.

In this embodiment, rolled tubular body 15 is immediately transferred to a welding stage, preferably located within the same tube-making machine. The welding stage pulls together free edges 101 and 103, such that they are touching or overlapping. Using high-speed electro-welding, a current (e.g. 3290 Amperes) is supplied to the welding element, which applies a series of welding spots along the overlapping junction of the two free edges. The centers of adjacent welding spots are separated, in this example, by 0.02 inches (0.5 mm) and each spot is applied with at least 90 pounds of force. Upon being applied, each weld spot expands to overlap its immediately adjacent neighbor, forming a continuous, air-tight, and pressure resistant weld seam 102. In one embodiment, the welding head remains stationary and the tubular body 15 is moved relative to the welding head in order to create the length of the weld seam 102, although the opposite arrangement is also possible, wherein the welding head moves relative to the stationary tubular body. By the completion of the welding process, a welded cylindrical container body 26 has been formed, with a constant diameter and open top and bottom ends. The welding process is designed to ensure that the aerosol container body 26 can withstand considerable stresses beyond typical aerosol pressurization, such stresses including drops and longitudinal or radial compression. Additionally, weld seam 102 must withstand the deformation and associated stresses of the sequential necking process.

After welding, a metal base 104 is attached (by crimping) to close and seal the open bottom end of the welded cylindrical container body 26, forming a container bottom. Here the metal base is shaped concave inwardly to withstand higher pressures. This metal base is generally thicker than the container sidewall 24; here the base is made out of a steel sheet 0.013 inches thick, and may be pre-formed concurrently with the container body form, or may be pre-formed separately. Preferably, after a flat circular form of the base is stamped from the steel sheet, a shaping apparatus, such as a hydraulic press or punch, is used to create a concavity in the middle portion of the base, leaving an outer ring of flat material around the interior concavity. This flat ring forms both the standing ring (for resting vertically upright on another surface) and the crimped lip of the base (for attachment to the sidewall) in the assembled container.

Figure 10:
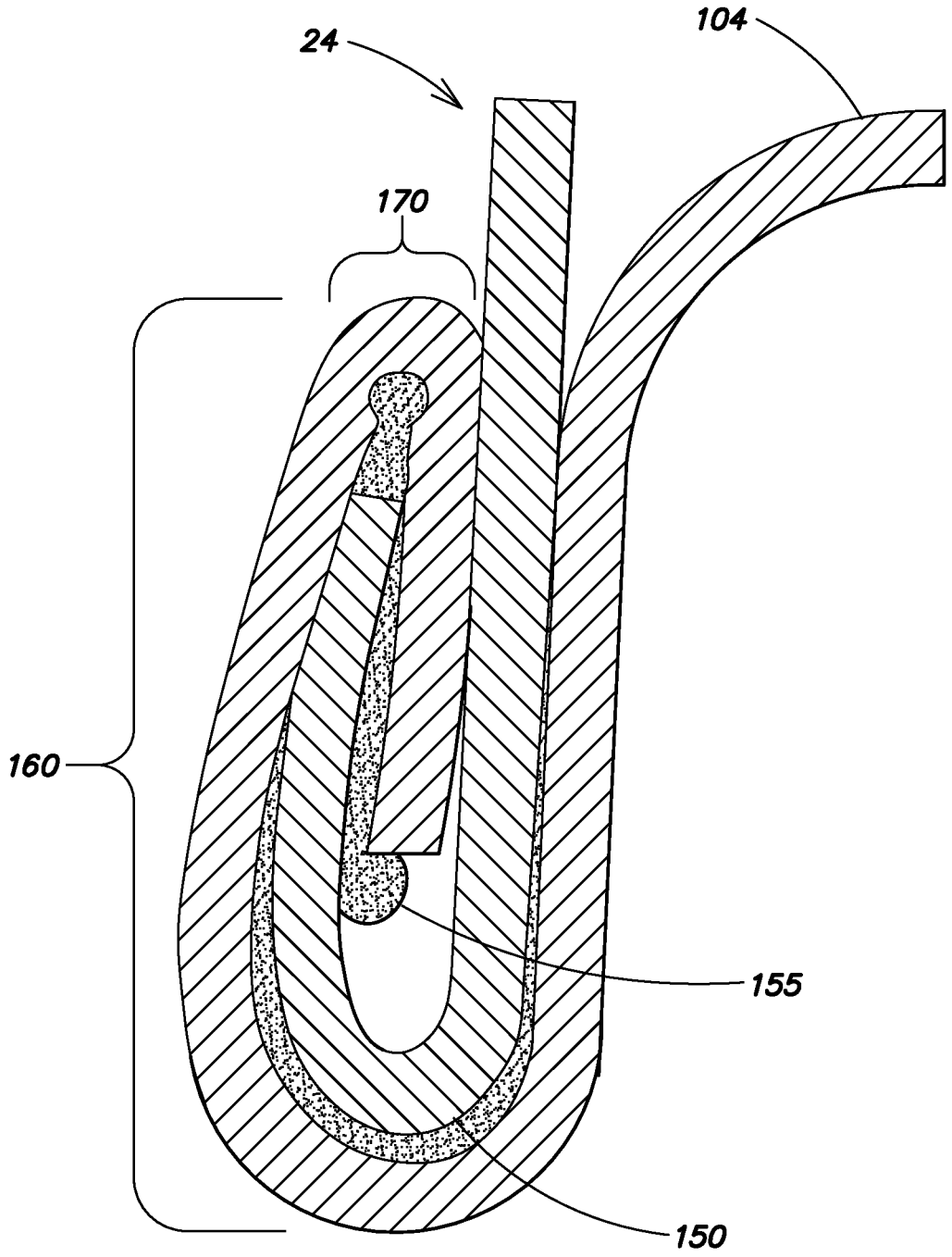
FIG. 10 is a cutaway view of one embodiment of a double seam crimp for attaching the base component to the body component.

FIG. 10 depicts a detail view of one embodiment of double seaming, for attaching the base 104 to the body sidewall 24. Double seaming is a standard practice used in can manufacturing to attach two components (most typically a container body and a base or top) through crimping, with or without the use of a supplementary adhesive 155. On the bottom end of bottom portion 24, the bottom edge is rolled such that an upturned lip 150 is formed, with the lip forming a J-shaped hook. The inwardly concave base 104 is inset slightly inside of the container body at bottom portion 24, with the metal material of the base being bent 180-degrees to travel up and over J-shaped lip 150 at the folded section 160, and subsequently being bent another 180-degrees at 170 to fit a folded section inside the upturned, J-shaped lip 150. With the metal layers thus positioned, they are crimped radially together, firmly securing the layers against loosening, and thereby forming the double seam.

Returning to FIG. 3, there is shown the assembled container body and base, after the concave metal base 104 has been attached but prior to the necking process at open top-end 115. The crimped seam 106 is clearly visible, and, while of a slightly larger diameter, is negligibly different from the diameter of the welded cylindrical container body 24. At an intersection point 120, the weld seam 102 becomes physically integrated with the crimped seam 106. Recalling the requirement of placing an upturned lip on the lower edge of the container body during the seaming process, it is important that the weld seam 102 be able to withstand the deformation and stress inherent in this 180-degree bend. It is likewise important that the weld seam be as flat as possible, so as to lay flush in the crimped seam.

Figure 4:
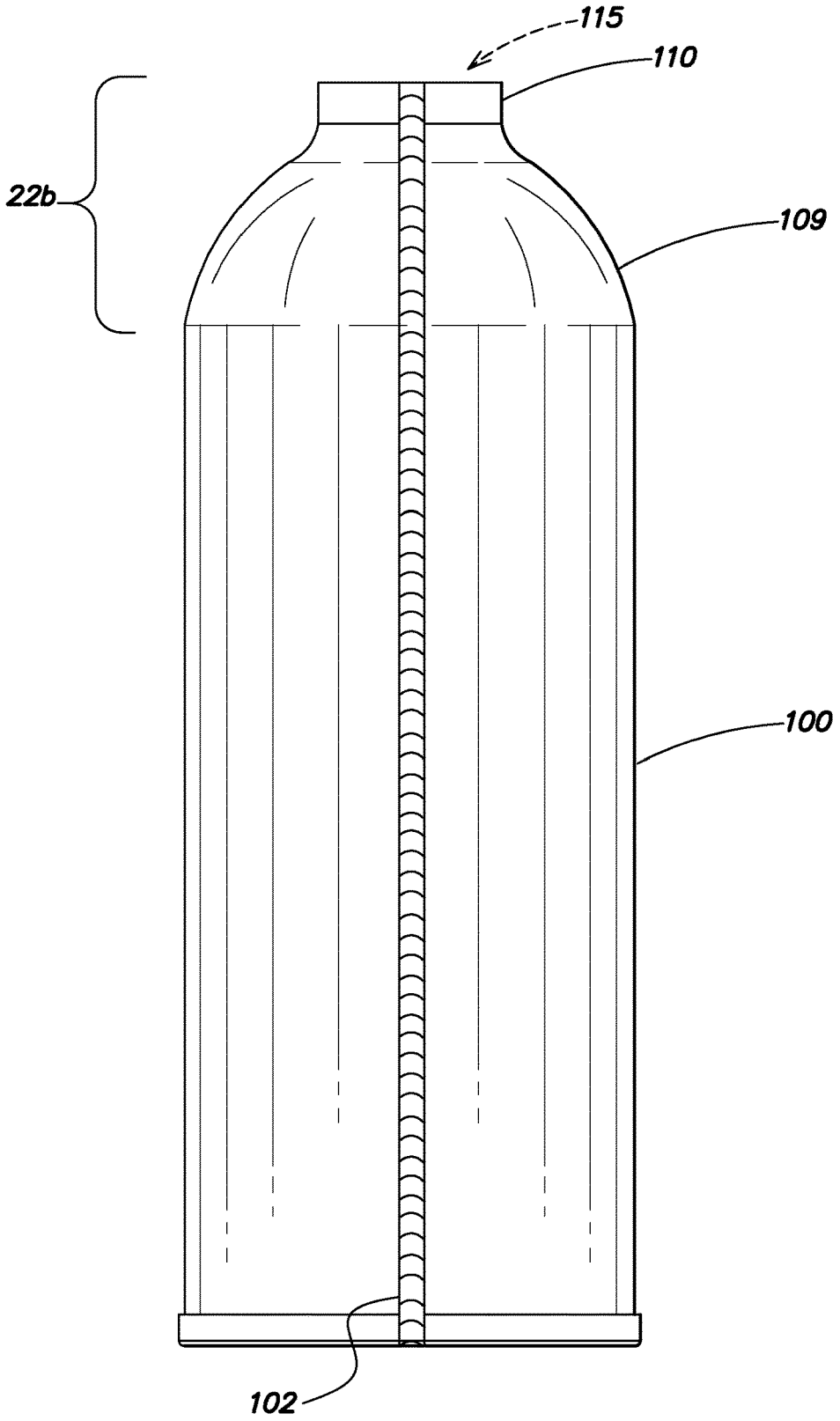
FIG. 4 is a front view of the final result of the sequential necking process, as applied to the container of FIG. 3.

After the concave metal base 104 has been attached via the crimped seam 106 to the welded container body 26, the assembly moves on to the necking stage of the process. The sequential necking process is carried out by a series of necking dies (e.g., as shown in FIG. 5C); typically several dozen intermediate reduction (necking) steps (dies) are required to produce the reduced diameter shoulder and neck portions, as depicted in FIG. 4. Through the use of a series of necking dies, top portion 22*b* is deformed and reshaped to the final dimensions of the shoulder 109 and neck 110 of the aerosol container. At this point in the process, the cylindrical neck simply terminates in an open top-end; curl 114 has yet to be formed on the cylindrical neck. The height and placement of top portion 22 may be varied, but in the preferred embodiment, the top portion 22 (shoulder, neck and lip) has a height of 1.3 inches, measured from the upper edge 107 of the cylindrical sidewall portion 100 to the uppermost surface of the curled lip.

The sequential necking process shapes the top portion 22*b* of the welded container body 26 through a series of deformation forces uniformly applied about the entire circumference of the container. These forces are applied in a number of sequential steps, with each individual step only producing a small component of the overall deformation that is required. For example, if the goal is to taper a 2-inch container sidewall down to 1-inch neck, a single necking step might only cause a reduction in diameter of ⅛ inch. FIG. 5A depicts this process, showing a front view of the result of a single necking operation, which causes a first reduction in diameter 200 of the top portion 22*b*.

To apply the necking force, a series of appropriately sized dies are required, with examples of such dies depicted in FIG. 5C. The opening diameter 171 of one necking die 170 is sized such that it is equal to or slightly larger than the starting diameter of the welded container body 26, such that the die may slip over the welded container body (along length 173 of the same opening diameter 171) without initially causing any deformation. Deformation does not occur until the welded container body makes contact with reduced diameter necking portion 172 of the die 170, wherein necking portion 172 is of a smaller diameter than either die opening 171 or container body 26. The diameter of necking portion 172 is responsible for the first reduction in diameter 200. The top portion 22*b* of the container is inserted in the first die 170 and mechanically pushed through the die along its entire length, with the resulting form again illustrated by FIG. 5A. This pushing process reshapes top portion 22*b* to have an outer diameter equal to the inner diameter of the die at necking portion 172. In an alternate embodiment, the die may move relative to a fixed container, rather than the scenario described above in which the container moves relative to a fixed die.

Subsequent necking operations follow the same procedure, although the diameter of the die continues to decrease in increments as needed, and additionally, the starting position of the die also varies. In tapered shapes, the greatest diameter is at the base of the top portion 22, and the container diameter will then decrease with height, moving towards open top-end 115. Consequently, each step begins at a higher initial longitudinal positioning than the step immediately prior, and the top portion 22*b* is pushed through a shorter distance. For example, in FIG. 5A, the first necking die operation 200 is applied over a distance equal to the entire height of the top portion 22. The second necking operation 202 is applied at a location above the first necking operation, and consequently over a shorter distance. The same is true of necking operation 204, which is applied over the shortest distance of any of the depicted necking operations. Necking die 180 of FIG. 5C demonstrates the reduction in diameter of necking portion 182 and the reduction in necking distance 183, as compared to the diameter of necking portion 172 and necking distance 173 respectively. The final result of three necking steps is shown in FIG. 5B as a series of three steps: 29*a*, 29*b*, and 29*c*; additional necking steps will occur (each starting above the last step) to complete the shoulder formation leaving a cylindrical neck portion of a constant second diameter, (substantially less than the starting first diameter of sidewall portion 24).

By deforming top portion 22*b* over dozens of such necking operations, the mechanical stresses in the metal are reduced in magnitude and therefore severity, and the weld seam 102 is prevented from wrinkling. If the top portion were to be bent (reduced) in a single necking operation, it would almost certainly fracture or otherwise deform in an undesirable or unexpected manner, beginning at weld seam 102. One skilled in the art will appreciate that a dome or tapered top portion formed in this step-wise (sequential) manner will not be perfectly smooth—the transition from one necking diameter to the next leaves a curve or corner, as seen in FIG. 5B. It is therefore advantageous to have a large number of distinct sequential necking steps in order to achieve the desired smoothness of tapered shoulder portion 109, as a larger number of steps more closely approximate the appearance of a smooth edge. In this embodiment, 42 distinct necking operations are performed to create the top portion 22 on the aerosol container.

Figure 5B:
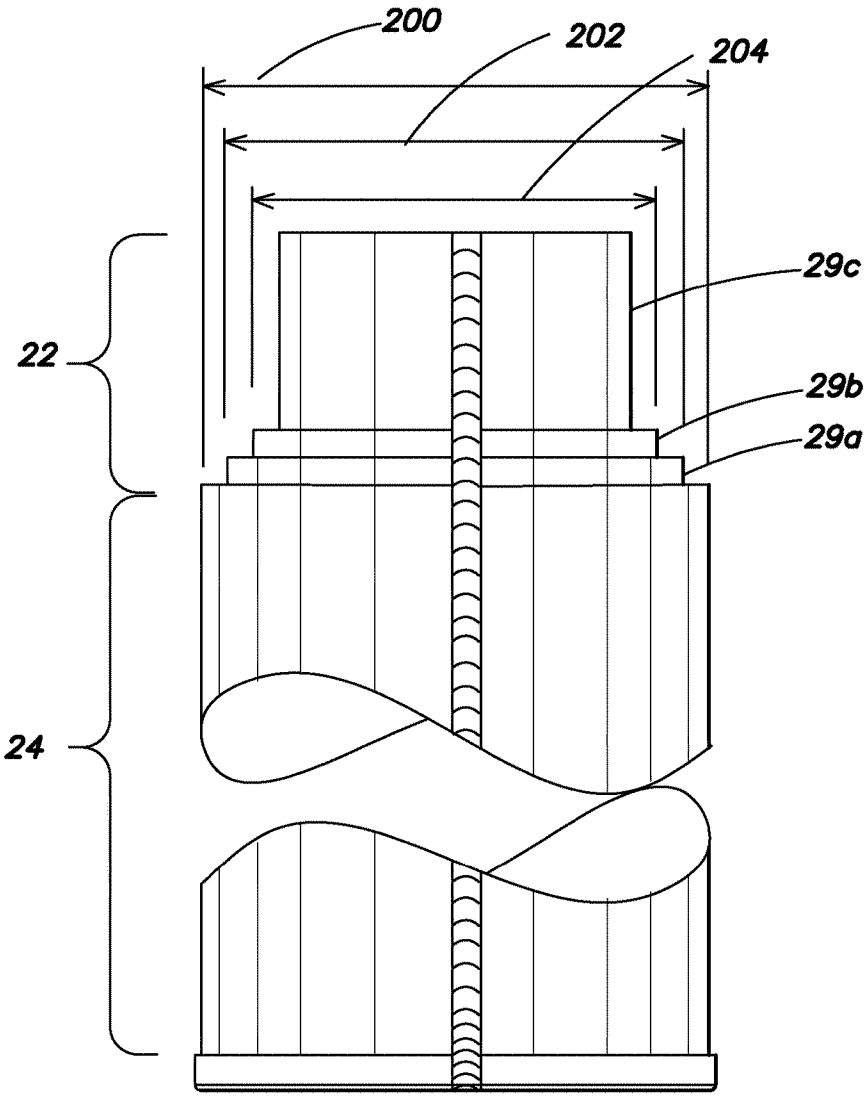
FIG. 5B is a front view of the result of three sequential necking operations, which cause a second and third reduction in diameter of the top portion, subsequent to the first reduction in diameter of FIG. 5A.
Figure 5A:
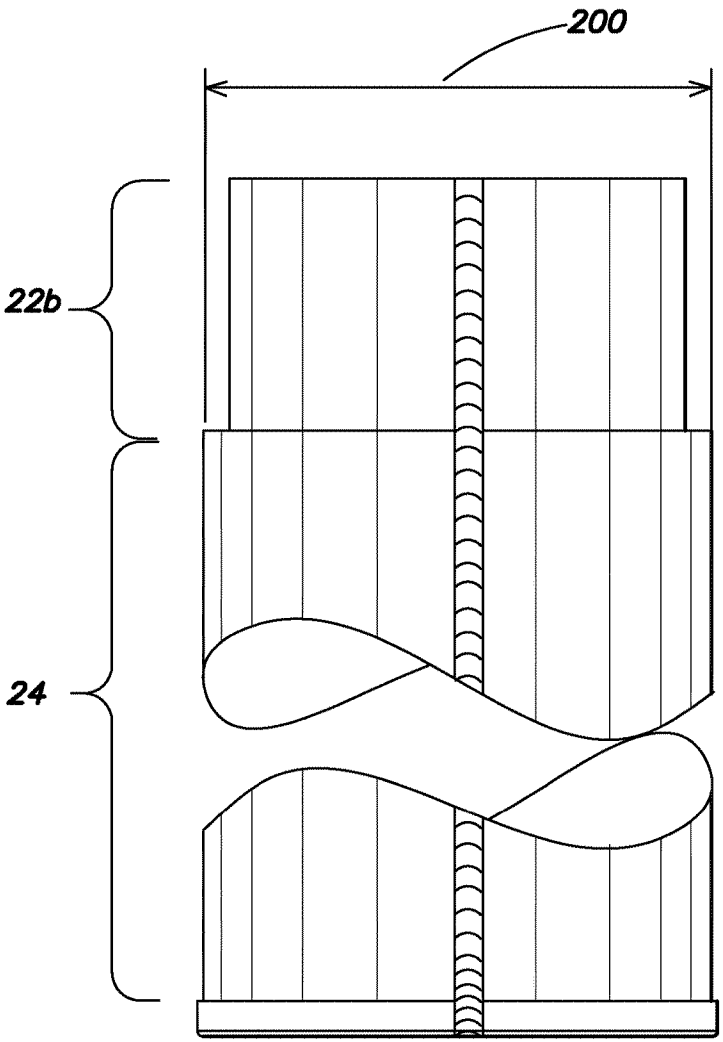
FIG. 5A is a front view of the result of a single necking operation, which causes a first reduction in diameter of the top portion.
Figure 5C:
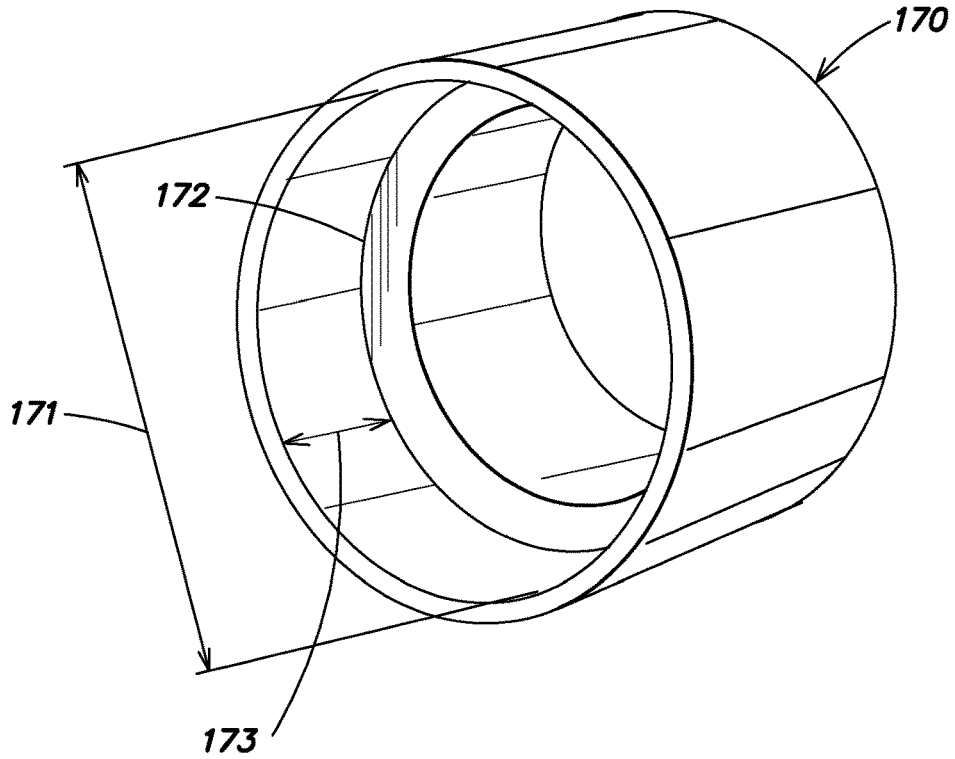
FIGS. 5C-5D are perspective views of two sequential necking dies, FIG. 5C showing a first necking die for reducing the diameter of the top portion and FIG. 5D showing a second necking die for further reducing the diameter of the top portion.
Figure 5D:
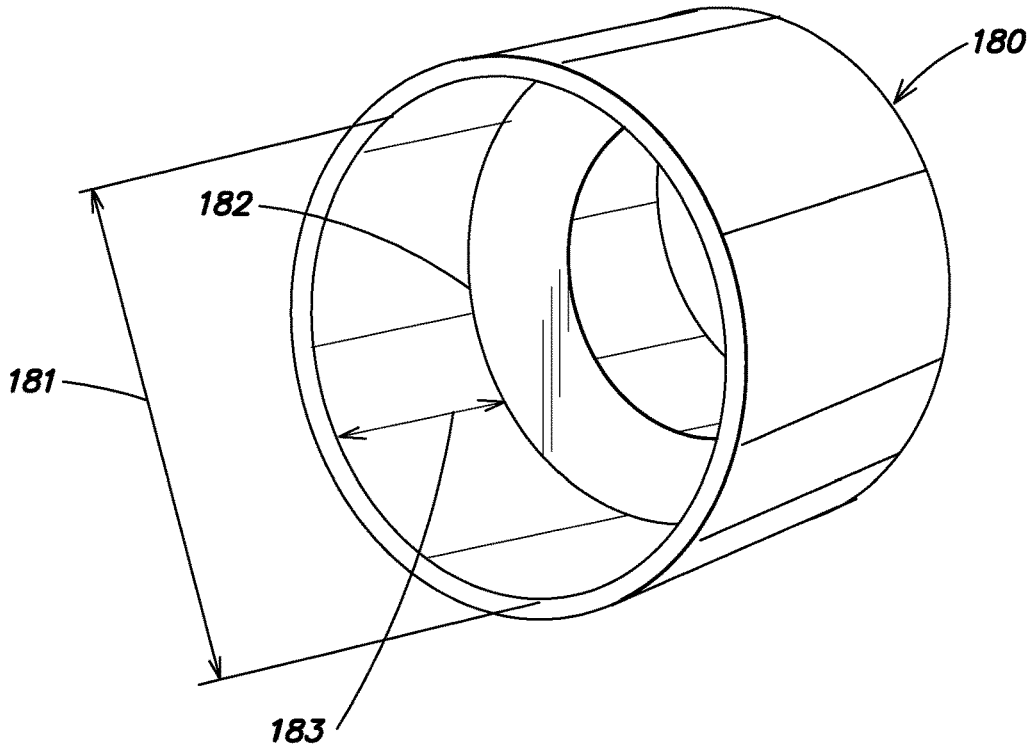

In FIG. 5B, each necking operation is represented as having caused the same amount of horizontal diameter reduction, although it is possible to adjust the diameter reduction as needed. For example, in one embodiment of the present invention, the shoulder portion 109 may be created as a domed (outwardly concave) shape. Starting from the top of the cylindrical sidewall portion 100, the diameter of the dome constantly decreases with height, in a non-linear manner. Consequently, different magnitudes of diameter reduction are needed for the distinct steps, and are preferably achieved through the application of a pre-determined number and order of varied necking dies. These adjustments to the necking dies have the additional consequence of changing the thickness of the container walls on the tapered shoulder portion 109—in one embodiment, the tapered shoulder portion wall is over 50% thicker at its upper end, than at its lower end, where the lower end is the same wall thickness as the cylindrical sidewall 100 of bottom portion 24.

Figure 6A:
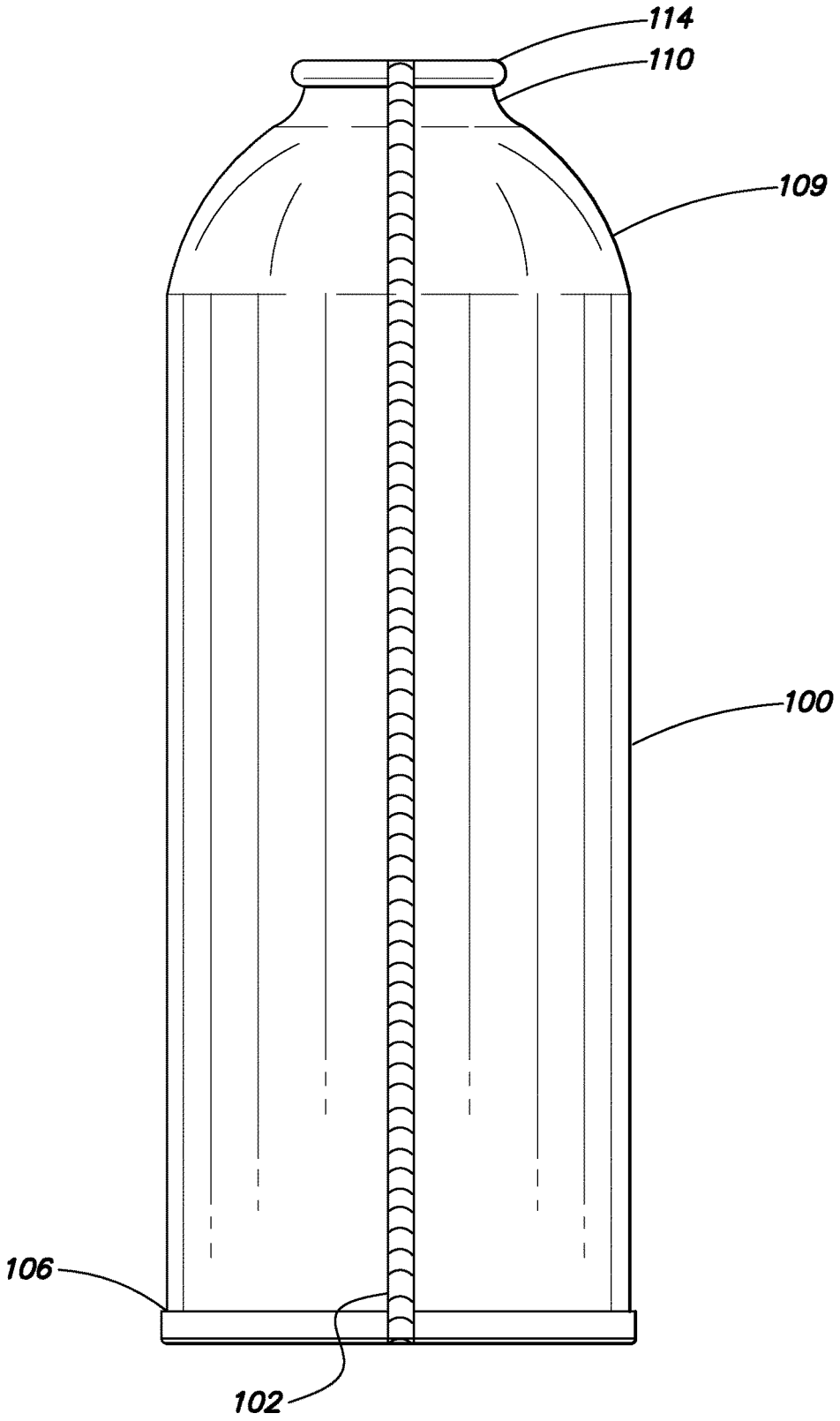
FIG. 6A is a front view of the completed two-piece aerosol container of FIG. 1, with a curled lip formed on the upper edge of the cylindrical neck portion.
Figure 6B:
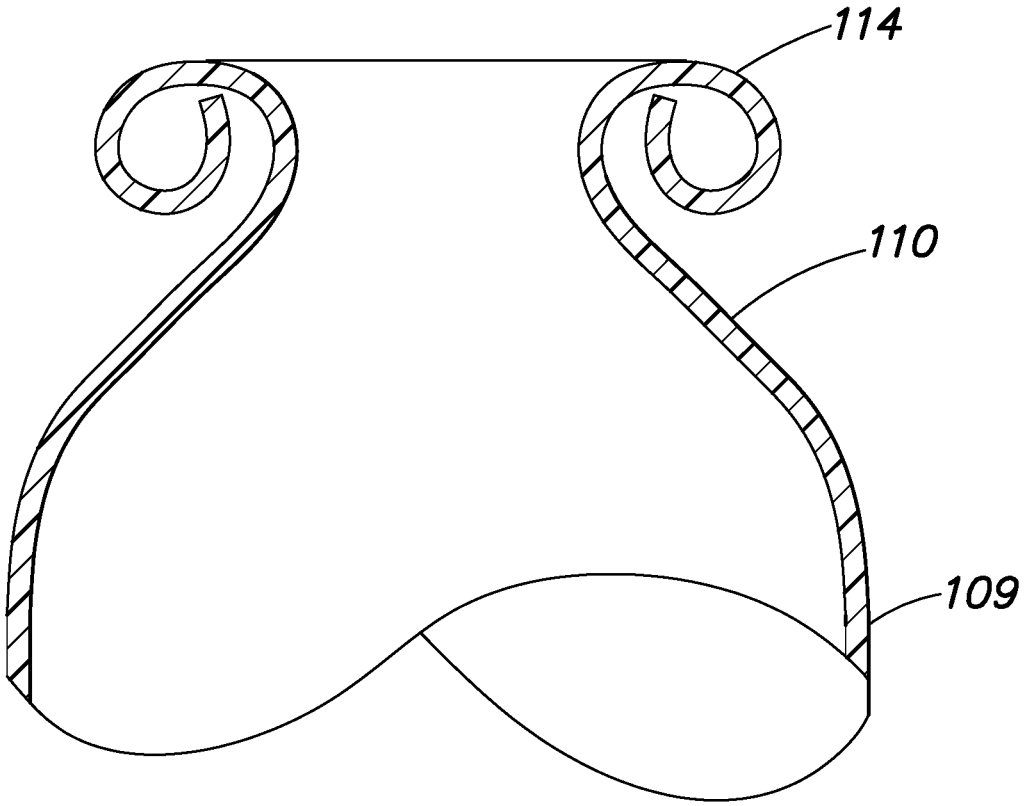
FIG. 6B is an exploded cross sectional view of a curl formed at the open top end of the container.

FIG. 6 depicts a completed two-piece aerosol container 20, with a curled lip 114 formed at the top end of the cylindrical neck portion 110. As mentioned previously, the neck portion 110 is created in the last steps of the necking process, through the application of a final necking die to create a constant diameter cylindrical neck portion at the upper end of the tapered shoulder portion 109. In one embodiment, the curling operation, to form curled lip 114 at the top end of the neck, takes place in the same machine as the necking operation, in a back-to-back fashion, and requires 18 steps.

The steps in the curling operation are similar to those of necking, in that small deformation forces are applied to the metal to cumulatively form a curl of the desired shape or form. However, while the necking forces that form the shoulder and neck are directed radially inwardly and axially upwardly, the curling operation directs the forces in a different manner to form curl 114 (as shown in cross section in FIG. 6A), first radially outwardly to create an elongated lip, axially downwardly to begin the curling process, and finally radially inwardly to complete curl 114. As a downward turning lip, curl 114 presents a smooth and radially reinforced lip, on the open end of the container. The smoothly curved and radially thickened nature of one embodiment of a curled lip is depicted in FIG. 6A. In combination with the previously mentioned increase of wall thickness of the top portion 22, the double-walled curled lip advantageously provides increased strength against deformation, which allows a manually actuatable aerosol valve and closure assembly 117 to be more securely fastened to the two-piece aerosol container 20.

Figure 7:
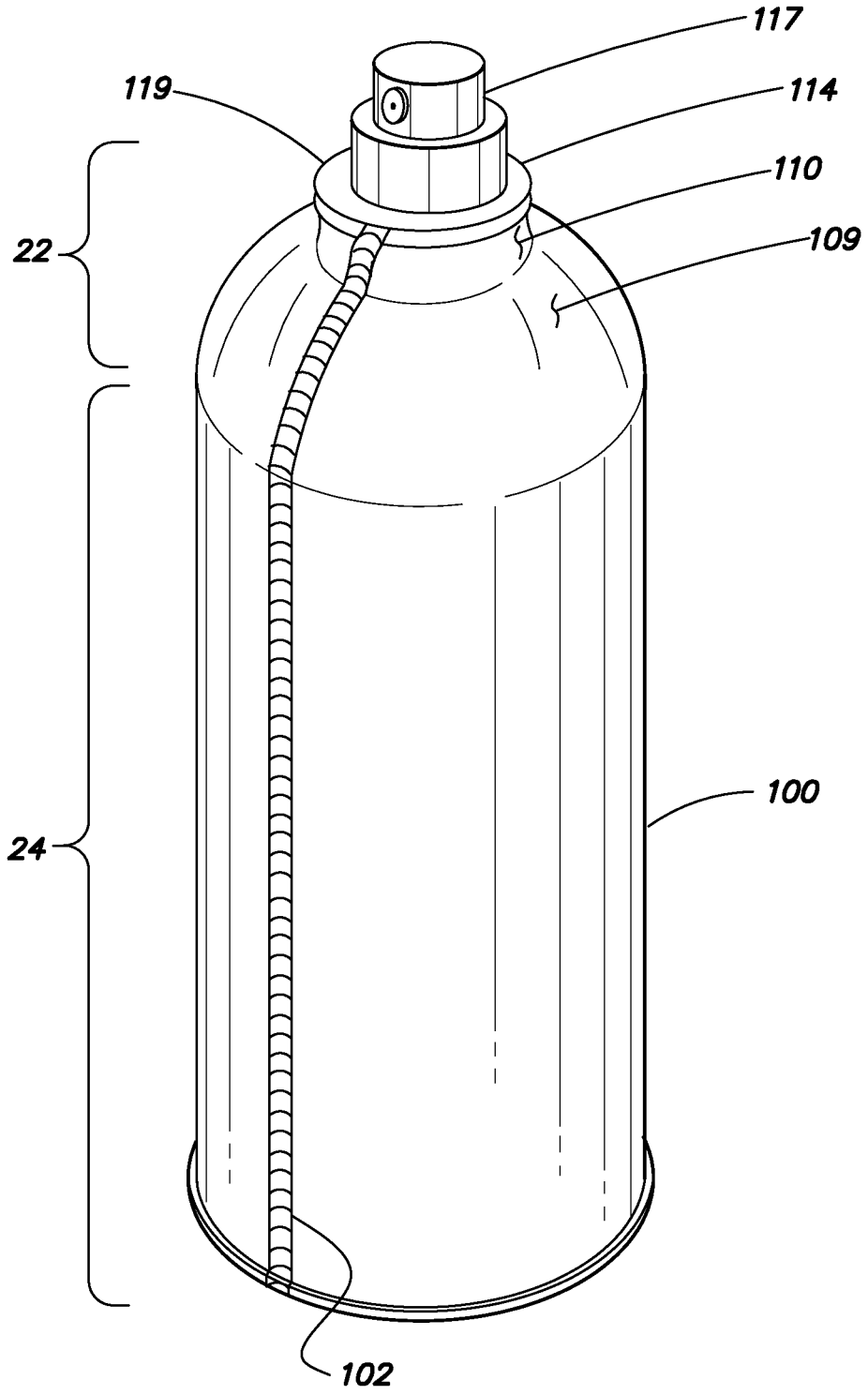
FIG. 7 is a perspective view of one embodiment of the metal aerosol container with a dispensing valve assembly securely fastened to the open top end of the container.
Figure 11:
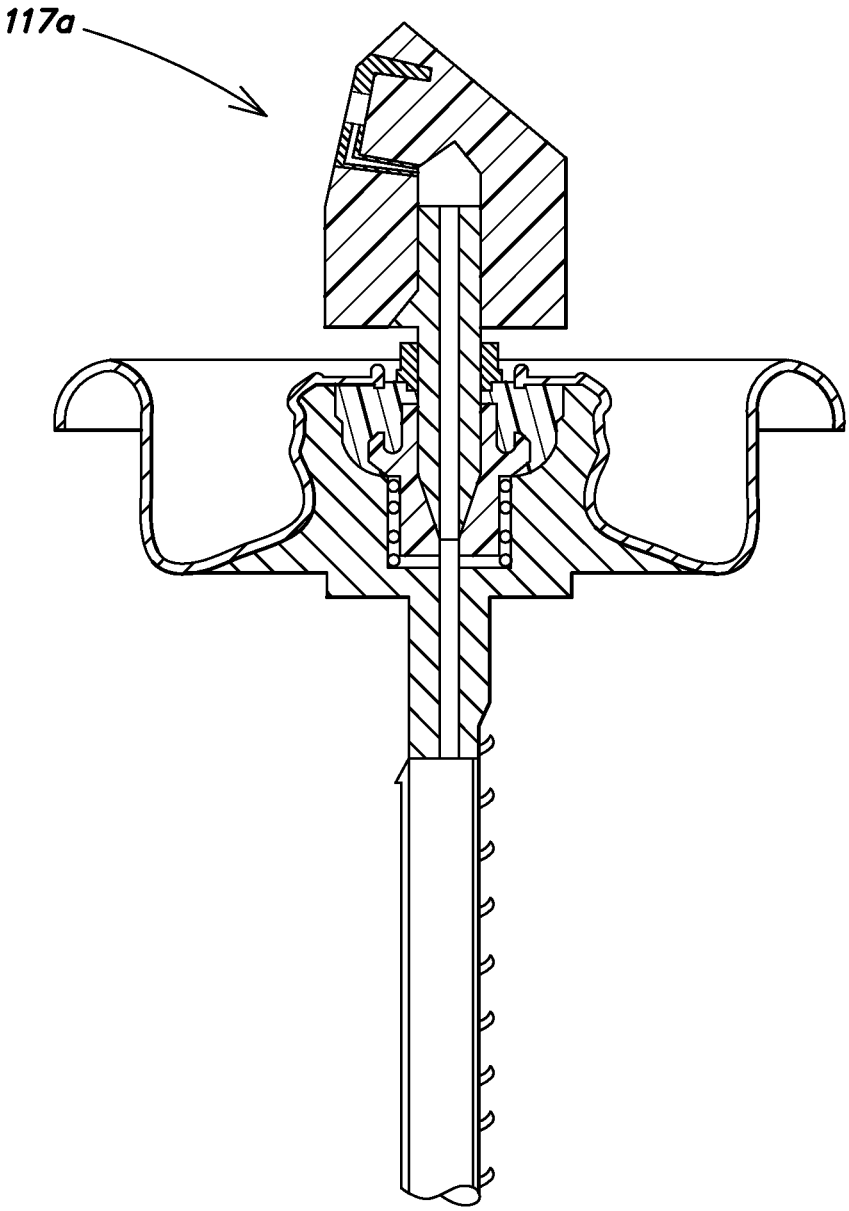
FIG. 11 is a front cutaway view of one embodiment of an aerosol dispensing valve assembly to be secured to the open top end of the container.

FIG. 7 shows one embodiment of a valve assembly 117 secured to the curled lip 114 to seal the open top end of the container 20. An alternate embodiment of a manually actuatable aerosol valve assembly 117A is depicted in FIG. 11 having a complimentary shaped cap portion to be crimped and/or otherwise secured by adhesive over the curl. Both valve assemblies are centrally disposed about the central longitudinal axis 50 of the aerosol container 20, although the two assemblies are of different widths and are disposed at different heights relative to the curled lip 114. One skilled in the art will appreciate that the design of aerosol valve closures suitable to be fastened to curled lip 114 of the present aerosol container 20 are not limited to those depicted, and that curled lip 114 may be configured to receive a wide range of closure assemblies.

Compared to the prior art three-piece welded steel aerosol container, the present two-piece container 20 offers improved strength and reduced weight. The strength of such a pressurized container is measured in its ability to resist deformation, and then if the pressure continues to increase, to resist burst. Using a hydraulic pressurization device, aerosol containers are tested to determine their deformation and burst points. Such a device seals and holds the aerosol container by the cylindrical neck portion 110, where the aerosol valve and closure assembly would otherwise be mounted. An airtight seal between the pressurization device and the container is established, and the container is suspended in mid-air, free of any surface contact points that could counter the pressure forces.

The two-piece aerosol container 20, starting at ambient pressure, is then slowly internally pressurized. It may be pressurized in steps, with pauses between successive increases, to simulate changes in climate or atmosphere it may undergo during normal use, or it may be continually pressurized. A deformation is considered to be any irreversible change in container geometry, such as a visible dent, that still maintains the pressurization level. The crimped seam 106 and the concave metal base 104 comprise the weakest parts of the aerosol container 20, and are therefore the failure locations. As depicted in FIG. 8A, after reaching a certain level of internal pressurization, the bottom of the aerosol container deforms outwardly, inverting from a symmetrical concave position 130 to a generally asymmetrical convex position 132. It is the metal base 104 that deforms—not the crimped seam 106 itself, although this seam certainly experiences stresses beyond a normally expected amount. In the present embodiment, the two-piece aerosol container 20 was found to deform at 256 psi (1765 kPa), a 36% improvement over the 188 psi (1300 kPa) deformation point of a three-piece construction of similar dimensions and materials tested on the same apparatus.

Figure 8B:
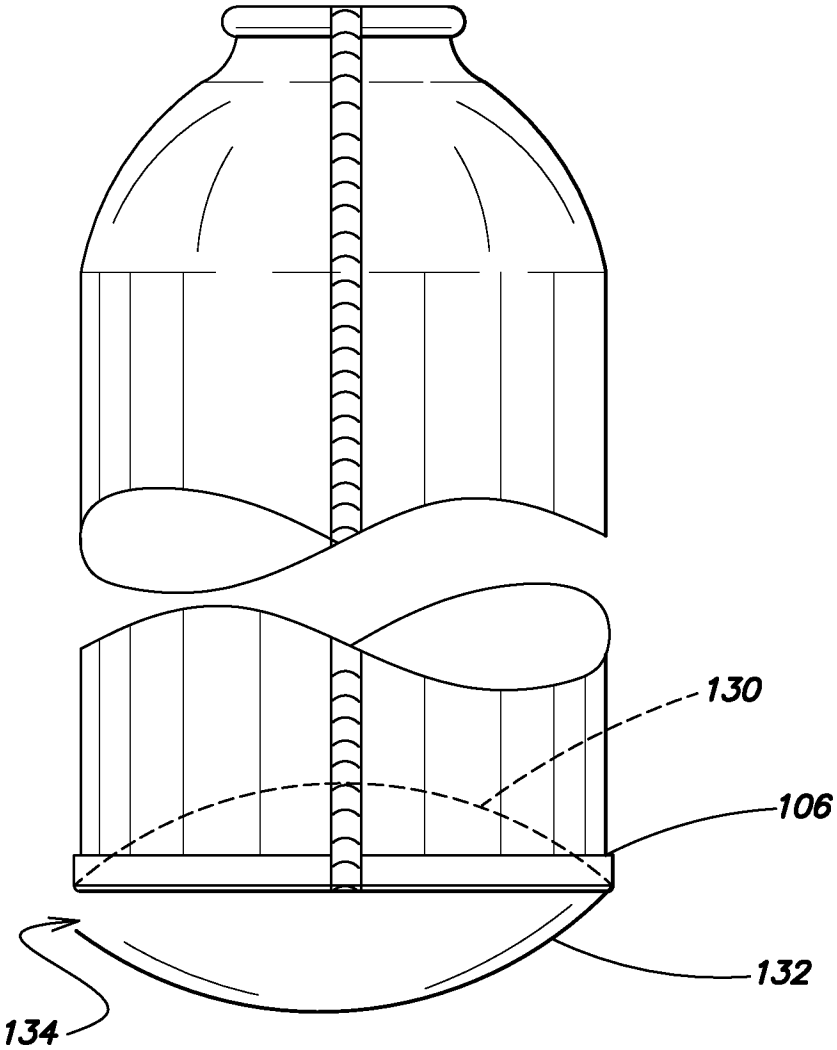
FIG. 8B is a front view of the two-piece aerosol container of FIG. 8A, wherein the bottom of the container has burst adjacent the crimped seam.
Figure 8A:
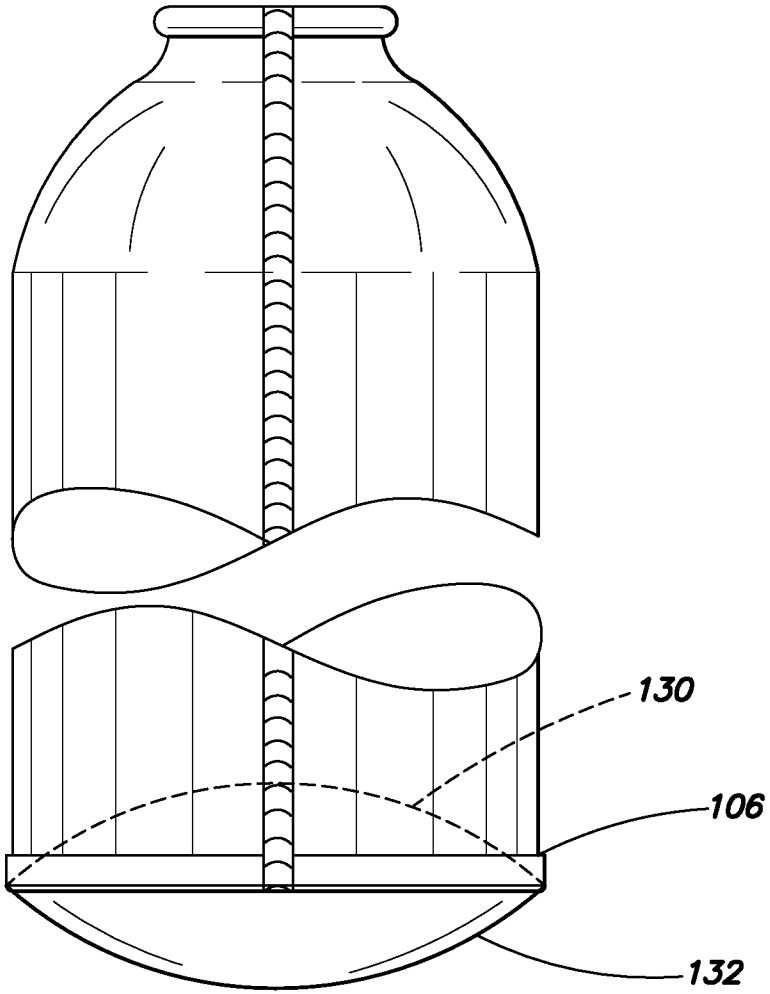
FIG. 8A is a front view of a two-piece aerosol container of FIG. 1, wherein the bottom of the container has deformed outwardly during testing (under very high internal pressure) into a generally asymmetrical convex position.

If pressure continues to build after deformation occurs, the two-piece aerosol container 20 will eventually burst (explode), as depicted in FIG. 8B, wherein a burst is considered to be any breach of the aerosol container walls that cause a loss of pressurization. Prior to deformation, the concave inward shape of metal base 104 was the portion of the metal container weakest against internal pressurization forces. However, with the metal base 104 now deformed into a concave outward shape 130, double seam 106 is now the weakest spot on the aerosol container 20. Consequently, the explosive failure will likely occur somewhere along this seam 106, illustratively depicted here as a failure point 134, although one skilled in the art will appreciate that such a failure point could be located anywhere along the circumference of crimped seam 106. In the present embodiment, the two-piece aerosol container 20 was found to explode at 311 psi (2150 kPa), a 30% improvement over the 239 psi (1650 kPa) explosion point of the three-piece construction.

Figure 9:
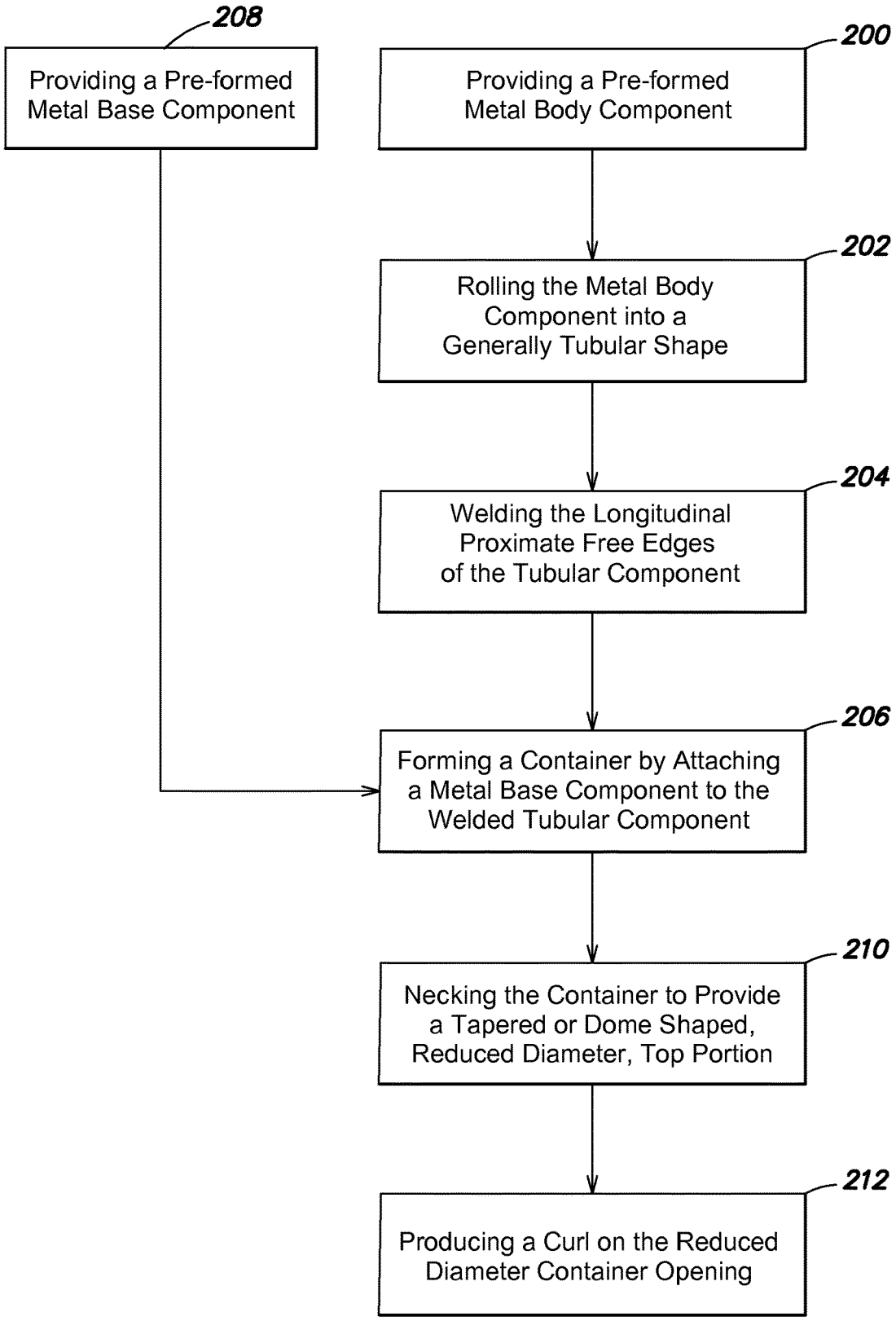
FIG. 9 is a flowchart depicting a method of manufacture of one embodiment of the present invention, for forming a two-piece aerosol container.

FIG. 9 is a flowchart depicting one embodiment of a method of manufacture of the present invention, wherein the two-piece aerosol container 20 is formed in a series of steps 200-206 that follow in a sequential manner, starting with step 200, which provides the pre-formed metal body component 10. While step 208 is placed side-by-side with step 200 in the vertical hierarchy of the flowchart, it is not a requirement that these two steps be performed simultaneously—step 208 only must take place before step 206, which requires as input the pre-formed metal base component 104 of step 208.

These and other embodiments of the invention will be apparent to the skilled person and the invention is not limited to the foregoing examples.

The invention claimed is:

1. A method for manufacturing a metal container adapted to receive a dispensing valve assembly for dispensing a pressurized or aerosol product from the container, wherein said container is formed from two pieces of metal, including the steps of:

providing a metal body component and a metal base component;

rolling the metal body component into a generally tubular shape having two longitudinal proximate free edges, and open top and bottom-ends;

welding the longitudinal proximate free edges of the tubular shape to form a longitudinal weld seam, thereby forming a welded cylindrical body of a first diameter with open top and bottom ends; and forming the container by:

forming and sealing the metal base component to the open bottom-end of the welded cylindrical body to form a closed container bottom;

after forming the closed container bottom, sequentially applying a series of reducing diameter necking dies about an outer circumference of a top portion of the welded cylindrical body such that:

the application of each necking die reduces the top portion to a given necking diameter and forms a non-tapered corner transition between each successive pair of necking diameters, such that the sequential application of the series of reducing diameter necking dies creates a shoulder portion consisting of a series of non-tapered corner transitions that approximate the appearance of a smooth edge; and the application of a final necking die creates a constant diameter neck portion extending from the shoulder portion, where the neck portion has a reduced second diameter relative to the first diameter of the welded cylindrical body;

forming a curl at the open top-end of the neck portion, the curl being configured to receive a dispensing valve assembly for dispensing a pressurized or aerosol product from the container;

wherein the weld seam extends continuously throughout the shoulder portion, neck portion, and curl.

2. The method of claim 1 wherein the container when sealed with a dispensing valve assembly and pressurized to 256 psi (1765 kPa) withstands deformation at 100° F. (37.7° C.) for at least 10 minutes.

3. The method of claim 1 wherein the container when sealed with a dispensing valve assembly and pressurized to 311 psi (2150 kPa) withstands explosive failure at 100° F. (37.7° C.) for at least 5 minutes.

4. The method of claim 1 wherein the metal body component has a height in a range of 2.5 inches to 9.5 inches and a first diameter in a range of 1.7 to 3.25 inches.

5. The method of claim 1 wherein the metal body component and the metal base component are each pre-cut from steel sheet.

6. The method of claim 1 wherein the second diameter is at most 50% of the first diameter.

7. The method of claim 6 wherein the second diameter is in a range of 40% to 50% of the first diameter.

8. The method of claim 6 wherein the second diameter is in a range of 20% to 40% of the first diameter.

9. The method of claim 1 wherein the welding step comprises applying welding spots at spaced positions along one or more of the free edges to form the weld seam.

10. The method of claim 1 wherein the necking dies produce a shoulder having an inwardly concave, outwardly concave, or a flat sloped shape.

11. The method of claim 1 wherein the series of necking dies stretch the top portion of the welded cylindrical body to form the shoulder and neck portions where the reduced second diameter of the neck portion is no greater than 50% of the first diameter without causing fracture or failure of the weld seam.

12. The method of claim 1 additionally comprising trimming excess material from the neck portion prior to forming the curl.

13. The method of claim 1, wherein the steps of manufacture are performed sequentially.

* * * * *